US007160091B2

(12) United States Patent
Baumeister

(10) Patent No.: US 7,160,091 B2
(45) Date of Patent: Jan. 9, 2007

(54) DEVICE FOR THE PRODUCTION OF MULTICOMPONENT FIBERS OR FILAMENTS, IN PARTICULAR BICOMPONENT FIBERS OR FILAMENTS

(75) Inventor: Michael Baumeister, Troisdorf (DE)

(73) Assignee: Reifenhauser GmbH & Co. Maschinenfabrik, Troisdorf (DE)

( * ) Notice: Subject to any disclaimer, the term of this patent is extended or adjusted under 35 U.S.C. 154(b) by 327 days.

(21) Appl. No.: 10/923,600

(22) Filed: Aug. 20, 2004

(65) Prior Publication Data

US 2005/0233018 A1 Oct. 20, 2005

(30) Foreign Application Priority Data

Aug. 23, 2003 (EP) ..... 03019114

(51) Int. Cl.
*D01D 5/08* (2006.01)

(52) U.S. Cl. ..... 425/72.2; 425/378.2; 425/382.2; 425/131.5

(58) Field of Classification Search ..... 425/72.2, 425/378.2, 382.2, 131.5
See application file for complete search history.

(56) References Cited

U.S. PATENT DOCUMENTS 3,659,989 A * 5/1972 Uraya et al. ..... 536/131.5
3,694,119 A * 9/1972 Scheibling ..... 425/133.5
3,877,857 A * 4/1975 Melead ..... 425/133.5
3,981,650 A * 9/1976 Page ..... 425/72.2
4,197,069 A * 4/1980 Cloeren ..... 425/131.1
4,344,907 A * 8/1982 Herrington ..... 264/171.26
4,600,550 A * 7/1986 Cloren ..... 264/173.13
4,708,618 A * 11/1987 Reifenhauser et al. ... 425/133.5
4,818,463 A * 4/1989 Buehning ..... 264/40.1
4,891,249 A * 1/1990 McIntyre ..... 427/208.6
5,017,116 A * 5/1991 Carter et al. ..... 425/131.5
5,145,689 A * 9/1992 Allen et al. ..... 425/72.2
5,173,141 A * 12/1992 Leseman et al. ..... 156/244.15
5,320,679 A * 6/1994 Derezinski et al. ..... 118/412
5,683,036 A * 11/1997 Benecke et al. ..... 239/413
5,685,911 A * 11/1997 Raterman et al. ..... 118/669
6,261,080 B1 * 7/2001 Schroter et al. ..... 425/378.2
6,336,801 B1 * 1/2002 Fish et al. ..... 425/7
6,478,563 B1 11/2002 Allen
6,491,507 B1 12/2002 Allen
6,565,344 B1 * 5/2003 Bentley et al. ..... 425/72.2
6,767,492 B1 * 7/2004 Norquist et al. ..... 264/173.15
7,001,555 B1 * 2/2006 Bentley et al. ..... 264/177.16
7,033,153 B1 * 4/2006 Allen et al. ..... 425/72.2
7,033,154 B1 * 4/2006 Allen et al. ..... 425/72.2

FOREIGN PATENT DOCUMENTS

DE 10143070 A1 6/2002
EP 1239 065 A1 9/2002
GB 1 204 339 12/1967

* cited by examiner

*Primary Examiner*—Joseph S. Del Sole
(74) *Attorney, Agent, or Firm*—Andrew Wilford

(57) ABSTRACT

Device for the production of multicomponent fibers or of filaments, in particular bicomponent fibers, whereby a nozzle block assembly is provided. The assembly consists of a middle nozzle block and two outer nozzle blocks. Arranged in the nozzle block assembly are at least two inflow channels, each for a melt flow of one component. At the lower end of the nozzle block assembly is a nozzle with apertures for the outlet of the multicomponent strands. At least one inflow channel runs over at least a part of its length exclusively through an outer nozzle block.

9 Claims, 2 Drawing Sheets

DEVICE FOR THE PRODUCTION OF MULTICOMPONENT FIBERS OR FILAMENTS, IN PARTICULAR BICOMPONENT FIBERS OR FILAMENTS

FIELD OF THE INVENTION

My present invention relates to a device for the production of multicomponent fibers or filaments, in particular bicomponent fibers or filaments, whereby a nozzle block assembly is provided for, consisting of at least one middle nozzle block and two outer nozzle blocks, whereby at least two inflow channels are provided in the nozzle block assembly for a melt flow of one component in each case, and whereby at the lower end of the nozzle block assembly a nozzle is provided with apertures for the output of multicomponent fibers or filaments. The device according to the invention is intended to be suitable for the manufacture of fibers or filaments for producing nonwoven webs, e.g. fibers in the meltblown process with a meltblown nozzle, as well as filaments for a spunbond material. The multicomponent fibers or filaments, in particular bicomponent fibers, can have a core-sheath structure or also a side-to-side arrangement of the two or more components.

BACKGROUND OF THE INVENTION

Devices for the production of multicomponent fibers are known from the prior art (U.S. Pat. No. 6,478,563 B1, U.S. Pat. No. 6,491,507 B1). With these known devices, two inflow channels, in which in each case a melt flow of one component for bicomponent fibers is conducted, run entirely in the middle nozzle block and along the edge of the middle nozzle block respectively. With these known devices, the thermal separation of the two melt flows represents a problem. In other words, as a rule there is mutual interference between the two hot melt flows. This leads to irregular or inhomogeneous temperature distribution, which in turn results in disadvantageous impairment of the flow consistency of the melts. These problems are particularly marked when the melting points of the two components exhibit significant differences, such as in excess of 50° C. This applies, for example, if one component is a polyolefin, such as polypropylene, and the second component is a polyester, such as polyethylene terephthalate (PET).

OBJECTS OF THE INVENTION

It is the object of the present invention to provide an improve device for producing bicomponent fibers or filaments of synthetic resin whereby drawbacks of prior art systems are avoided.

More particularly it is an object of the invention to provide an improved device for producing bicomponent synthetic resin fibers or filaments which is relatively inexpensive, can ensure a homogeneous temperature distribution and can be used even when the melting points of the two components are relatively disparate.

SUMMARY OF THE INVENTION

These objects are attained, in accordance with the invention with a device for producing bicomponent synthetic resin fibers or filaments which comprises:

a nozzle block assembly formed by a middle nozzle block and a pair of outer nozzle blocks flanking said middle nozzle block, said nozzle block assembly having passages for melts of respective components of the fibers or filaments; and a spinneret at a lower end of the nozzle block assembly formed with at least one nozzle orifice from which a bicomponent strand formed by said melts emerges, at least one of said passages having an inlet channel formed exclusively in one of said outer nozzle blocks and communicating with a continuation channel running through the remainder of said nozzle block assembly and defined between said one of said outer nozzle blocks and the middle nozzle block.

According to a feature of the invention, one of the passages is traversed by one of said melts, another of said passages traversed by the other of said melts having an inlet channel formed exclusively in the other of said outer nozzle blocks and communicating with a continuation channel running through the remainder of said nozzle block assembly and defined between said other of said outer nozzle blocks and the middle nozzle block.

The device can be provided with air jets or the like capable of breaking up the emergent strands of the synthetic resins so that it is particularly suitable for use in the melt blown process for forming melt blown webs.

According to a feature of the invention, each inflow channel runs in an area of a respective melt intake exclusively through a respective outer block.

Cavities can be provided in the middle nozzle block for thermoinsulation and can be distributed over an entire working width of the assembly. The cavities can be holes which extend over at least one part of a vertical height of the nozzle block assembly.

Heating devices can be provided in the middle nozzle block and in at least one of the two outer nozzle blocks for setting heating temperatures therein.

At least one outer nozzle block can have a heating device therein arranged next to an inflow channel.

According to another embodiment, the nozzle is a spinning nozzle for the production of filaments for a spunbond fabric. It is then possible to work with the device in accordance with the spunlaid process.

The invention is based on the recognition that, because of the design of the device according to the invention, a surprisingly homogenous temperature distribution can be ensured in the melt flows of the two components. As a result, in each case a very uniform flow of the melt flows can be achieved in the inflow channels. It must be particularly surprising to the person skilled in the art that the disadvantages known from the prior art can be eliminated with such simple and non-elaborate means. In principle, it is sufficient if, within the framework of the invention, the melt flows and inflow channels respectively run only in the melt intake area exclusively through an outer nozzle block.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
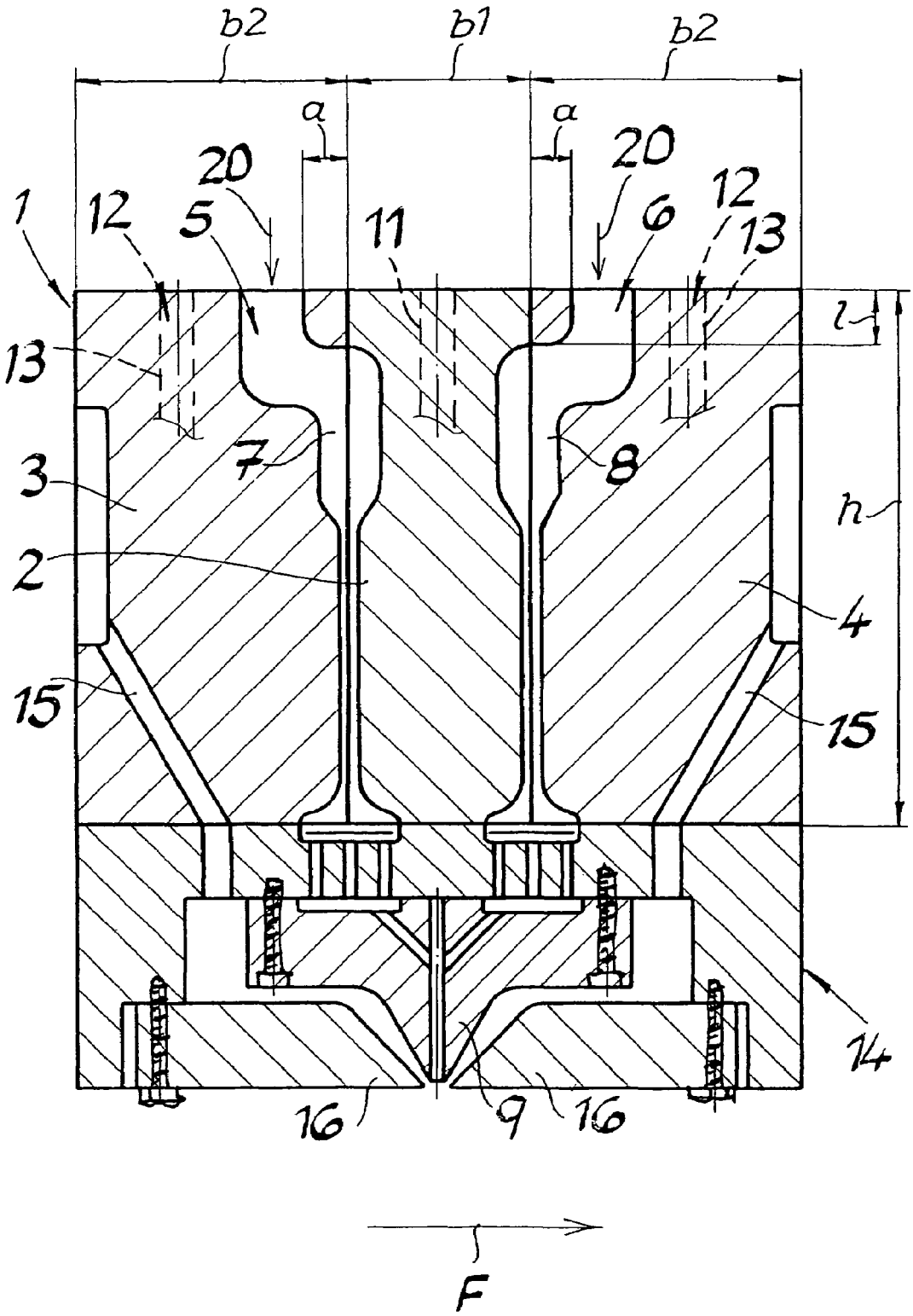
FIG. 1 is a section through a device according to the invention with a meltblown nozzle.

The figures show a device for the manufacture of bicomponent fibers or filaments. The device of FIG. 1 comprises a nozzle block assembly 1, which in the embodiment shown 25 consists of a middle nozzle block 2 and two outer nozzle blocks 3, 4, namely a left nozzle block 3 and a right nozzle block 4. The nozzle blocks 2, 3, 4 connect directly to one another and extend over the entire working width or web width respectively of the device (i.e. perpendicular to the plane of the paper). Working width or web width is understood in this context to mean the extent of the device perpendicular to the direction of conveying of a fiber product being manufactured, for example onto the conveying device of a nonwoven material strip.

Arranged in the nozzle block assembly 1 are two inflow channels 5, 6, each for a melt flow 7, 8 of a component. At the lower end of the nozzle block assembly 1 is a nozzle 9 with apertures 10 for the outlet of the bicomponent fibers. A row of such apertures 10 extends over the entire working width of the device. In the embodiment according to FIG. 2, several rows of apertures 10 extend over the entire working width or mould width of the spinneret portion of the assembly.

According to a greatly preferred embodiment and in the embodiment shown, the first inflow channel 5 runs over a part of its vertical length exclusively through the first outer or left nozzle block 3, and the second inflow channel 6 runs over a part of its vertical length exclusively through the second outer or right nozzle block 4. Vertical length is understood in this context to mean the extent of an inflow channel 5, 6 in the direction of the vertical height h of the nozzle block assembly 1. According to a greatly preferred embodiment and in the embodiment example, in this situation both inflow channels 5, 6 run in the area of the melt intake 20 of the nozzle block assembly I exclusively through the outer nozzle block 3, 4 in each case. For preference, and in the embodiment shown, the distance interval a of the part of the inflow channel 5, 6 with the vertical length I and the middle nozzle block 2 is at least 0.5 to 5 times the diameter of the inflow channel 5, 6. It falls within the framework of the invention that the width b2 of an outer nozzle block 3, 4, amounts to 0.3 to 4 times that of the middle nozzle block 2.

Figure 2:
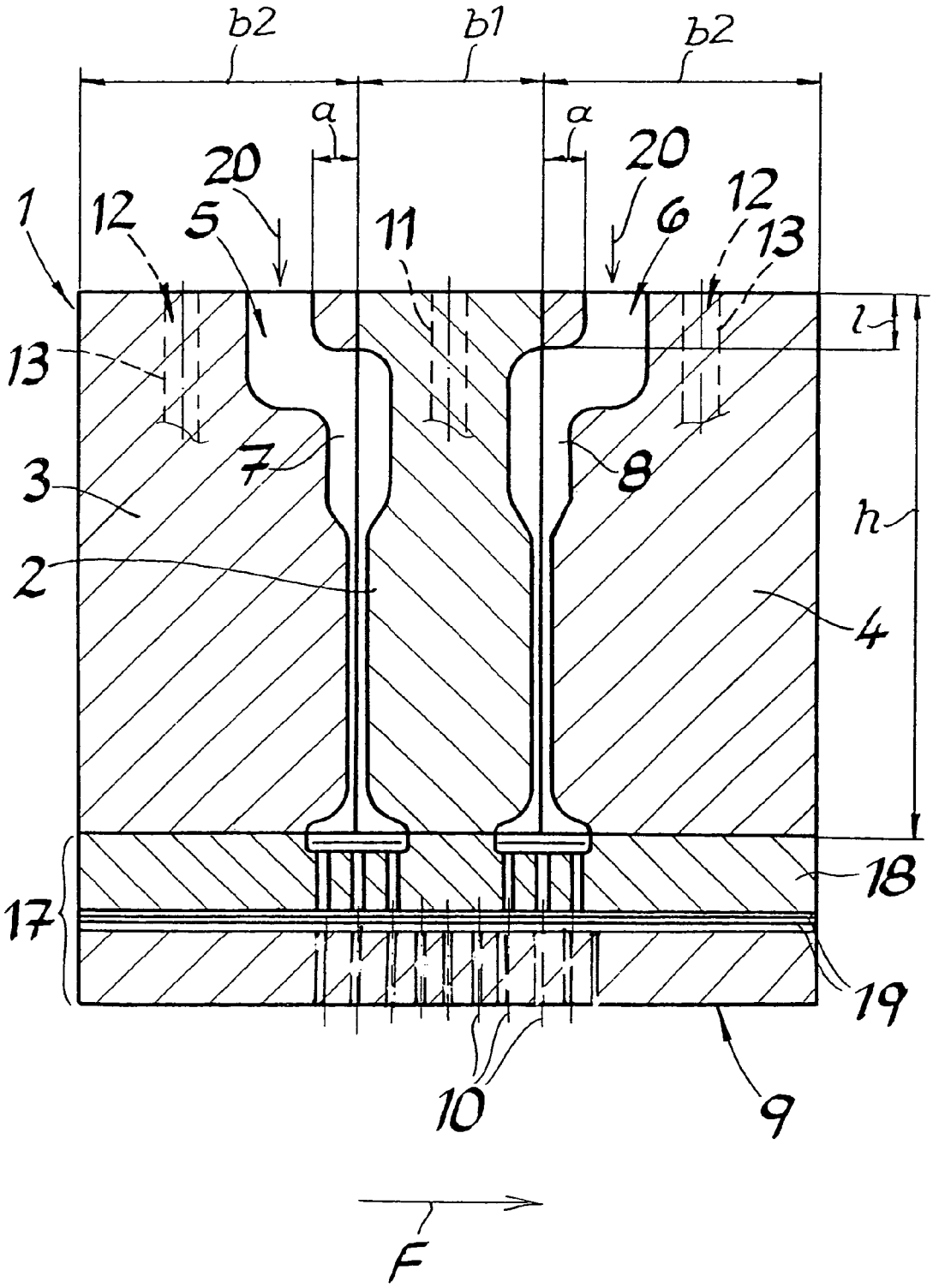
FIG. 2 is a section through a nozzle block assembly with a spinning nozzle for the manufacture of a spunbond fabric.

In FIGS. 1 and 2 it is indicated that, according to a preferred embodiment, vertical holes 11 are located between the inflow channels 5, 6, for the thermal insulation or thermal separation of the two melt flows 7, 8. To the purpose, these vertical holes 11 are only filled with air. The vertical holes 11 are for preference distributed over the entire working width of the device.

It is further indicated in FIGS. 1 and 2 that, in the left nozzle block 3, left of the first inflow channel 5, a heating device 12 is located, with which the temperature required for the first melt flow 7 can be adjusted simply and without any problem. The heating devices 12 are for preference and in the embodiment realized as holes 13, in which heating cartridges, not represented in any greater detail, are inserted. Such a heating device 12 and hole 13 respectively can be identified on the right next to the second inflow channel 6. With the aid of the vertical holes 11 on the one hand, and with the heating devices 12 on the other, a very effective thermal separation of the two melt flows 7, 8 can be achieved, and accordingly an especially homogenous temperature distribution can be ensured in the melt flows 7, 8.

The device according to FIG. 1 is, moreover, well-suited to the performance of a meltblown process. Beneath the nozzle block assembly 1 can be identified an exchange cassette 14 with the meltblown nozzle 9. In addition to this, the infeed channels 15 for a fluid medium, for preference hot air, can be identified, typical for the meltblown process. In the lower area of the exchange cassette 14 air lips 16 are provided.

By contrast, FIG. 2 shows a device for the manufacture of a spunbonded fabric. Beneath the nozzle block assembly 1 a spinning package 17 can be identified, which consists of a perforated plate 18, distribution plates 19, and the spinning nozzle 9 with openings 10 or spinneret nozzle orifices respectively. In principle the possibility also pertains of using the device for the manufacture of multicomponent films.

I claim:

1. A device for producing bicomponent synthetic resin fibers or filaments, comprising:

a nozzle block assembly formed by a middle nozzle block and a pair of outer nozzle blocks flanking said middle nozzle block, said nozzle block assembly having passages for melts of respective components of the fibers or filaments; and a spinneret at a lower end of the nozzle block assembly formed with at least one nozzle orifice from which a bicomponent strand formed by said melts emerges, at least one of said passages having an inlet channel formed exclusively in one of said outer nozzle blocks and communicating with a continuation channel running through the remainder of said nozzle block assembly and defined between said one of said outer nozzle blocks and the middle nozzle block.

2. The device defined in claim 1 wherein said one of said passages is traversed by one of said melts, another of said passages traversed by the other of said melts having an inlet channel formed exclusively in the other of said outer nozzle blocks and communicating with a continuation channel running through the remainder of said nozzle block assembly and defined between said other of said outer nozzle blocks and the middle nozzle block.

3. The device according to claim 2 wherein each inflow channel runs in an area of a respective melt intake exclusively through a respective outer nozzle block.

4. The device according to claim 2 wherein cavities are provided in the middle nozzle block for thermal insulation, and said cavities are distributed over an entire working width of the assembly.

5. The device according to claim 4 wherein the cavities are holes which extend over at least one part of a vertical height (h) of the nozzle block assembly.

6. The device according to claim 2, further comprising heating devices in the middle nozzle block and/or in at least one of the two outer nozzle blocks for setting heating temperatures therein.

7. The device according to claim 6 wherein, in at least one outer nozzle block at least one heating device is arranged next to an inflow channel.

8. The device according to claim 2 wherein the nozzle assembly is a meltblown nozzle assembly.

9. The device according to claim 2 wherein the nozzle assembly is a spinning nozzle assembly for the production of filaments for a spunbond fabric.

* * * * *